US007588236B2

(12) United States Patent
Belanger

(10) Patent No.: US 7,588,236 B2
(45) Date of Patent: Sep. 15, 2009

(54) DEVICE FOR GATHERING PRINTED PRODUCTS

(75) Inventor: Roger Robert Belanger, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 155 days.

(21) Appl. No.: 11/360,293

(22) Filed: Feb. 23, 2006

(65) Prior Publication Data

US 2007/0194519 A1 Aug. 23, 2007

(51) Int. Cl.
*B65H 37/04* (2006.01)

(52) U.S. Cl. ..... 270/52.16; 270/52.14; 270/58.23; 270/58.29

(58) Field of Classification Search ..... 270/52.14, 270/52.16, 58.23, 58.29; 271/204; 198/470.1
See application file for complete search history.

(56) References Cited

U.S. PATENT DOCUMENTS 4,936,562 A 6/1990 Rowe ..... 270/56
4,978,117 A * 12/1990 Maier et al. ..... 271/206
5,007,624 A * 4/1991 Chandhoke ..... 270/58.2
5,080,337 A * 1/1992 Mayer et al. ..... 270/1.02
5,188,349 A * 2/1993 Honegger ..... 270/52.22
5,320,341 A 6/1994 Pease et al.
5,522,587 A 6/1996 Banks et al.
5,660,382 A * 8/1997 Meier ..... 270/52.16
5,788,446 A 8/1998 Stolz ..... 412/9
5,884,747 A * 3/1999 Sandstedt et al. ..... 198/349.95
6,082,724 A 7/2000 Kahlig et al.
6,446,953 B1 * 9/2002 Felix et al. ..... 270/52.19
6,572,101 B2 6/2003 Kaya et al. ..... 271/210
6,769,678 B2 8/2004 Hobbs ..... 271/11
2002/0129893 A1 9/2002 Winter et al.
2004/0239026 A1 * 12/2004 Nagai ..... 270/58.08
2006/0027960 A1 * 2/2006 Richter et al. ..... 270/58.08

FOREIGN PATENT DOCUMENTS

EP 399188 A2 * 11/1990

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

A gathering device for forming a plurality of printed products includes a transfer device having a plurality of grippers. A first sheet material feeder delivers first sheet material to the plurality of grippers and a second sheet material feeder delivers second sheet material to the plurality of grippers, the second sheet material feeder being downstream of the first sheet material feeder. A conveyor receives the first or second sheet material from the grippers. A method is also provided.

19 Claims, 3 Drawing Sheets

DEVICE FOR GATHERING PRINTED PRODUCTS

BACKGROUND OF THE INVENTION

The present invention relates generally to devices for gathering printed products such as perfect binders and to methods for gathering printed products.

U.S. Pat. No. 6,082,724 describes a signature collating apparatus such as an inserter having a plurality of hoppers delivering sheet materials to newspapers in pockets. Repair sheet material article feeders can be provided. U.S. Pat. No. 6,082,724 is hereby incorporated by reference herein.

U.S. Pat. No. 5,788,446 discloses a method and apparatus for making books, brochures and similar products with a perfect binding and is hereby incorporated by reference herein.

U.S. Pat. No. 6,769,678 discloses a device for separating a lowermost flat product from a stack of flat products and is hereby incorporated by reference herein. The device may also include a separator element insertable in a space defined between the lowermost flat product and the next adjacent flat product.

Gathering devices such as perfect binders, saddle stitchers and mailroom inserters may use hoppers to collect sheet material. A saddle stitcher or perfect binder may for example collect folded printed materials from hoppers onto a saddle or perfect binder conveyor, respectively, to form a magazine or other printed product.

In addition, saddle stitchers and perfect binders may collect printed materials for selective bookbinding. Selective bookbinding occurs when magazines or other printed products contain information unique or personalized to each magazine or printed product. Often, the products are collected and formed in a specific sequence to minimize distribution costs, for example, carrier route sequencing used by the United States Postal Service. Thus, gathering devices may work more efficiently when the printed products receive the corresponding personalized information and the printed products maintain sequencing.

Different versions of gathered printed products, for example, different saddle stitched products or collections of inserts, can be produced on the fly for example by having twice the number of hoppers required for the versions. In other words, sixty hoppers spaced equally along a conveyor line can provide for two products each with thirty separate sheet materials to be produced on the fly.

Hoppers also sometimes misfeed during transfer, often via a transfer drum, to the transfer device, for example by not providing a printed material or providing a double. If a double is provided, the collected product on the conveyor can be discarded. If a hopper fails to feed a printed material, repair may be provided, for example, by actuating a duplicate repair hopper further down the conveyor line to provide the missing printed material. In some cases, for example with pocket conveyors, the pockets can be recycled past the hopper that misfed to provide the missing material. As an alternative to the automatic repair systems, the conveyor may be stopped and the product repaired by hand.

BRIEF SUMMARY OF THE INVENTION

The present invention provides a gathering device for forming a plurality of printed products including a transfer device having a plurality of grippers. A first sheet material feeder can selectively deliver first sheet material to the plurality of grippers and a second sheet material feeder can selectively deliver second sheet material to the plurality of grippers, the second sheet material feeder being downstream of the first sheet material feeder. A conveyor receives at least one of the first or second sheet material from the grippers.

By providing a transfer device for two sheet material feeders, such as hoppers, and then having the transfer device at the conveyor, the length of the conveyor can be shortened considerably while still permitting versioning. This is because the feeders associated with the transfer device can be spaced to the side of the conveyor and need not be in line.

Also, the second sheet material feeder could be used advantageously as a replacement hopper, for example, providing the same product as the first sheet material feeder, and thus reduce misfeeds at the conveyor.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
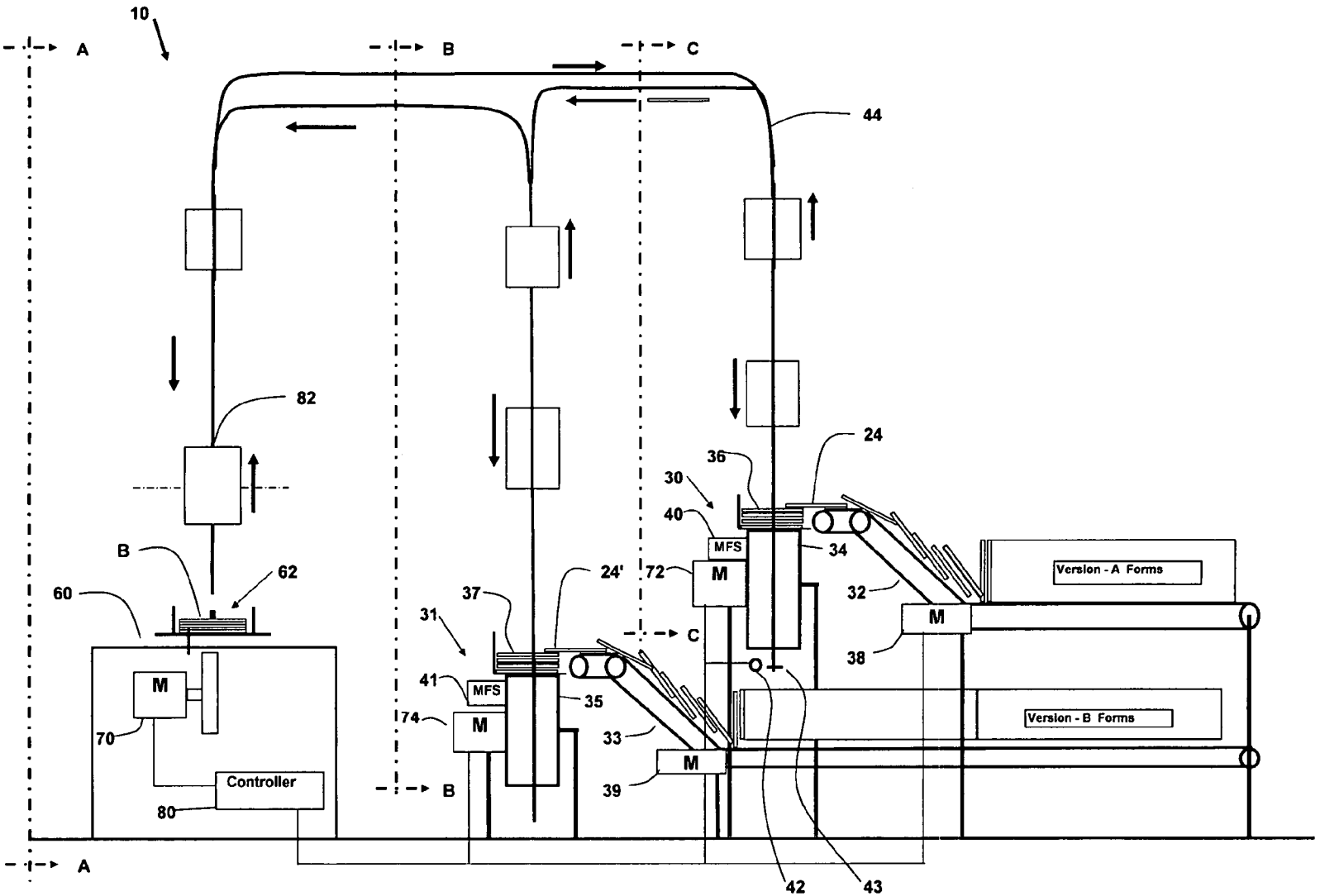
FIG. 1 shows a side view of a dual feed hopper according to the present invention.

FIG. 1 shows a dual feed hopper 10 including a transfer device 44, a first hopper 30, a second hopper 31, a conveyor 60, and a controller 80.

Transfer device 44 circulates between first hopper 30, second hopper 31 and conveyor 60 transporting sheet material 24, 24' between first hopper 30, second hopper 31 and conveyor 60. Hoppers 30, 31 may be for example a modified RG-318 hopper available from Goss International, Inc. of Dover, N.H., or other hopper. Transfer device 44 has a plurality of grippers 82. Transfer device 44, can be, for example, a GOSS NP-200 gripper system available from Goss International of Dover, N.H. or other gripper system.

First hopper 30 includes a conveyor 32, a transfer drum 34, a stack 36 of sheet materials 24 and a servo motor 38. Second hopper 31 includes a conveyor 33, a transfer drum 35, a stack 37 of sheet materials 24' and a servo motor 39. Conveyors 32, 33 transport sheet materials 24, 24' to stacks 36, 37 respectively. Transfer drums 34, 35 transfer sheet materials 24, 24' from stacks 36, 37 to grippers 82. Servo motors 38, 39 drive conveyors 32, 33. Sheet material 24 may be identical, for misfeed replacement, or not identical to sheet material 24', for on-the fly versioning. First hopper 30 and second hopper 31 are preferably spaced laterally with respect to one another.

A misfeed sensor 40 is provided for hopper 30 and a misfeed sensor 41 is provided for hopper 31 to detect problems with delivery of sheet materials 24, 24'. Typically, one sheet material 24 or 24' should be fed to gripper 82. Misfeed sensors 40, 41 can detect the presence of more than one sheet material 24 or 24' delivered to gripper 82 or the absence of sheet material 24, 24'. A home sensor 42 can also detect a home position 43 of the transfer device 44 and the location of each gripper 82 so that the location of the gripper 82 with the misfeed or problem can be determined. This home position 43 can also be used to determine or know which gripper 82 has which product 24, 24', since the home position and the distances between the hoppers are fixed and known.

Conveyor 60 is preferably laterally spaced with respect to first hopper 30 and second hopper 31. Conveyor 60 has sheet material receiving locations 62, which may be perfect binder spaces, for example, with pin spacing P.

A servo motor 70 drives transfer device 44 and conveyor 60, which may or may not have a phasing device between them, and may provide encoder information back to a controller 80. A servo motor 72 drives first hopper 30 and a servo motor 74 drives second hopper 31. Controller 80 receives information from and controls servo motors 70, 72, 74, 38, 39, home sensor 42 and misfeed sensors 40, 41. By knowing the home position 43, the position and content of each gripper 82 traveling around transfer device 44 is known. Controller 80 also thus can set the gathering device for on-the-fly versioning or misfeed repair.

Figure 2:
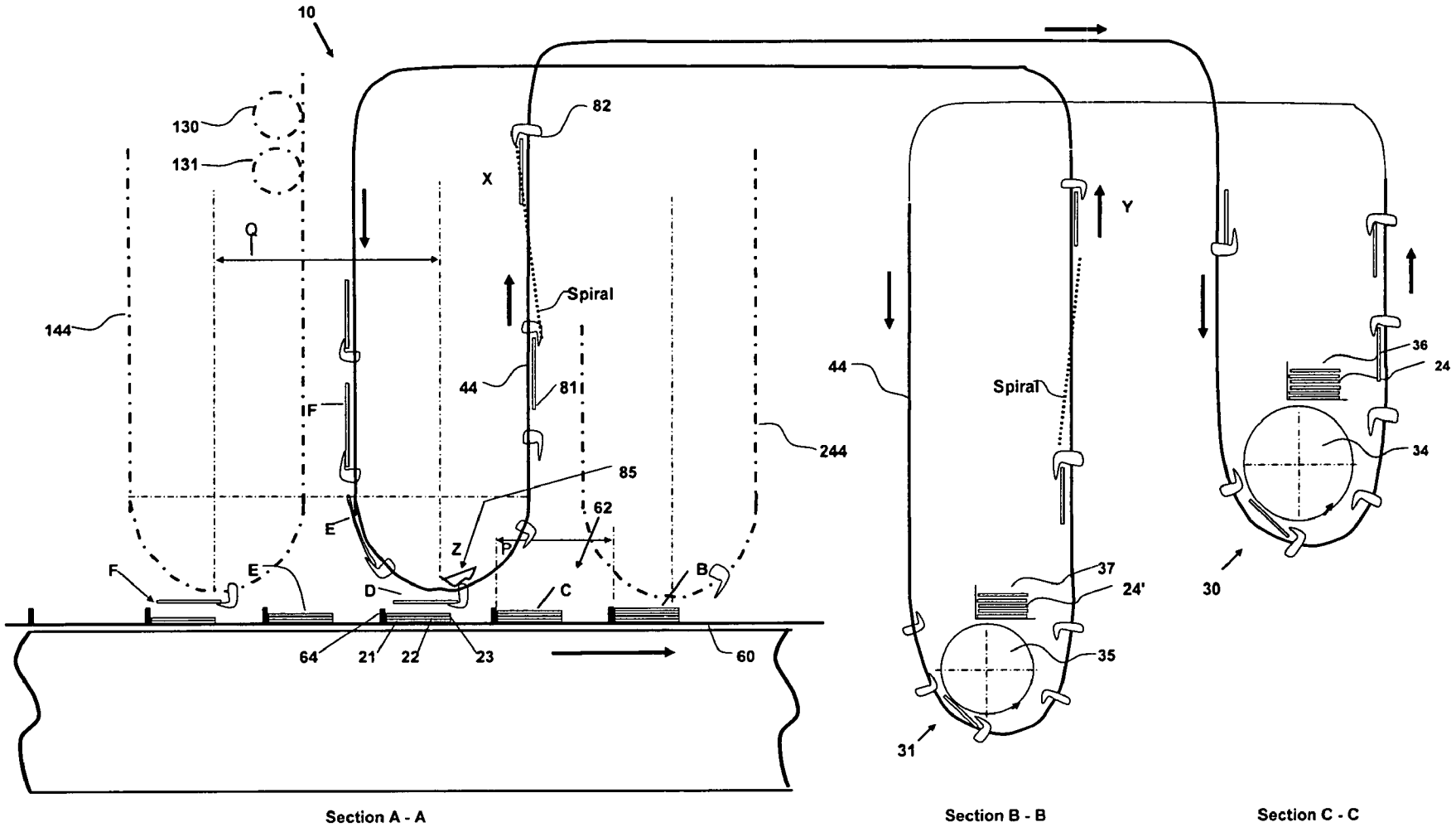
FIG. 2 shows a view of a dual feed hopper with a transfer device depositing sheet material on a perfect binder conveyor and FIG. 3 shows a view of a dual feed hopper with a device depositing sheet material on a saddle conveyor.
Figure 3:
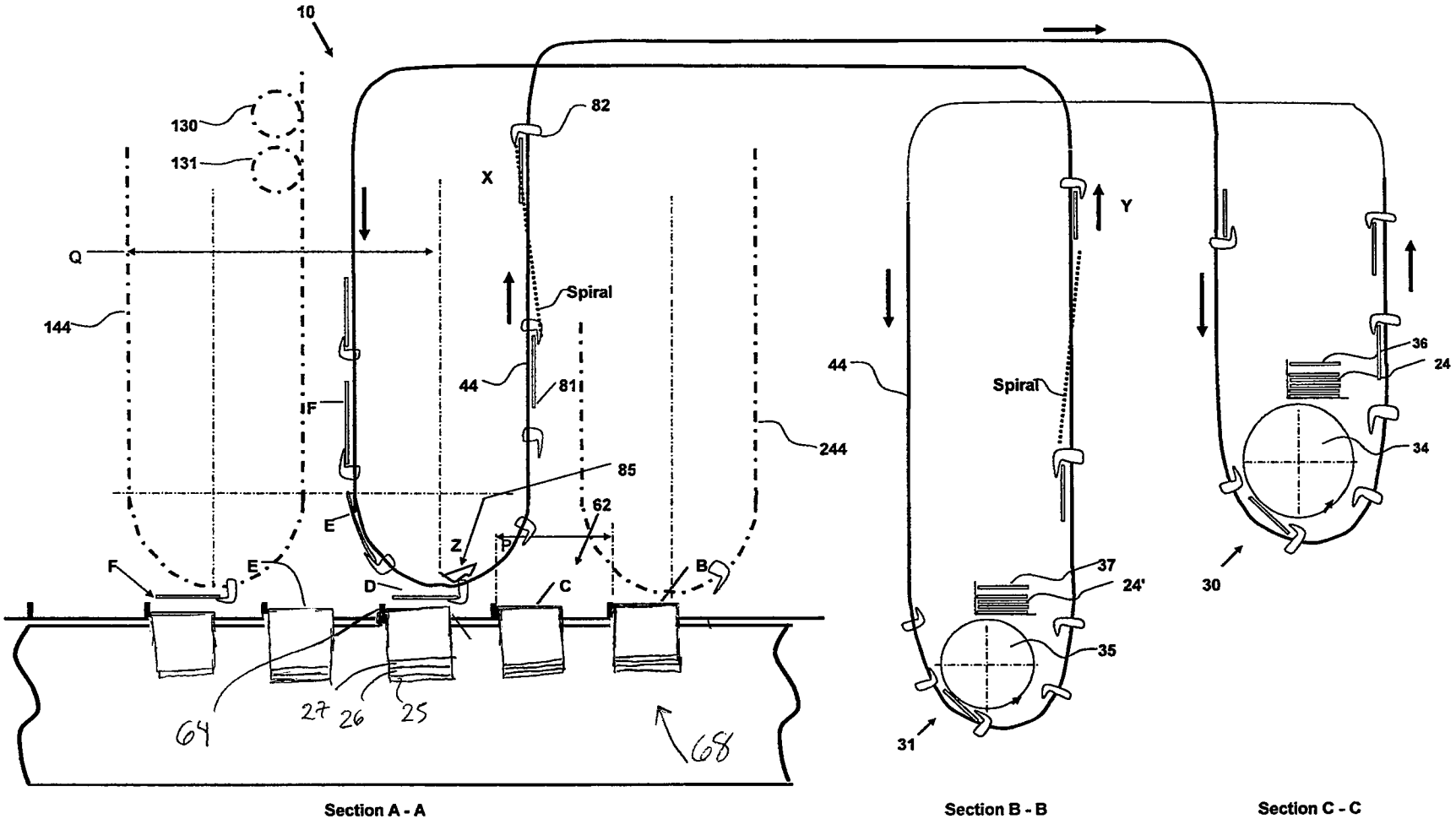

FIG. 2 and 3 show a view of a dual feed hopper 10 depositing sheet material 24, 24' on a conveyor, for example, perfect binder conveyor 60 (FIG. 2) or saddle conveyor 68 (FIG. 3), by an transfer device 44, and a transfer device, 144 upstream from transfer device 44 and a transfer device 244 downstream from transfer device 44. It should be understood that each transfer device 144, 244 is associated also with two sheet material feeder devices 130, 131, shown schematically, as described above. Thus, for example, 120 sheet material feeders could be provided, and sixty transfer devices. The length of the conveyors 60, 68 would only need to be 60 times the transfer device width at the conveyor, and thus much less than if 120 sheet material feeders were provided in line. Such a device would thus allow on-the-fly versioning or repair capabilities with a much shorter length, which can be extremely important as size constraints for printing plants are often of great importance.

In FIG. 2, a plurality of products B, C, D, E, F is being formed on perfect binder conveyor 60. A first product to be collected thus can be designated as product B, a second product, C, a third product D, through products E, F, etc. Products B, C, D, E, F to be completed on conveyor 60 will each have collected sheet materials 21, 22, 23, etc. previously collected from the delivery of sheet material from one of the transfer devices 144, 44, 244. In FIG. 3, a plurality of products B, C, D, E, F is being formed on saddle conveyor 68. Products B, C, D, E, F to be completed on saddle conveyor 68 will each have collected sheet materials 25, 26, 27, etc. previously collected from the delivery of sheet material from one of the transfer devices 144, 44, 244.

When gripper 82 reaches a position Z as shown in FIG. 2 and 3, a cam 85 may cause gripper 82to release sheet material 24, 24' onto conveyor 60 or 68 at receiving location 62 having a pin 64. Sheet material 24, 24' is gathered in perfect binder conveyor 60 along with the previously collected sheet materials21, 22, 23, etc., sheet material 23 having been delivered by transfer device 144 (FIG. 2). Sheet material 24, 24 ' is gathered in saddle conveyor 68 along with the previously collected sheet materials 25, 26, 27, etc., sheet material 27 having been delivered by transfer device 144 (FIG. 3). Then gripper 82 moves along transfer device 44 and spirals into a position X shown in FIG. 2 and 3. Gripper 82 moves downstream along transfer device 44 to first hopper 31.

In one scenario, gripper 82 receives sheet material 24 from hopper 30 via transfer drum 34. Gripper 82 travels downstream along transfer device 44 to second hopper 31. Here, controller 80 inhibits delivery of sheet material 24' from hopper 31 to gripper 82. After passing second hopper 31, gripper 82 spirals into a position Y shown in FIG. 2. Gripper 82 moves further downstream and deposits sheet material 24 at receiving location 62 if desired, as controlled by controller 80.

In another scenario, gripper 82 may not receive sheet material 24 from transfer drum 34 due to a misfeed, for example. If misfeed sensor 40 senses a miss or double, controller 80 has second hopper 31 deliver sheet material 24' to gripper 82 (if a double has been produced, the gripper 82 may release the doubled product to a waste or recycle bin). Thus, gripper 82 moves downstream to second hopper 31 and receives sheet material 24', which in this case is the same as sheet material 24, from transfer drum 35. Then, gripper 82 spirals into a position Y shown in FIG. 2. Gripper 82 moves further downstream via transfer device 44 and deposits sheet material 24' at receiving location 62 if desired, as controlled by controller 80.

For on-the-fly versioning, sheet material 24' may not be identical to sheet material 24. This may occur for example when variations or different versions are desired among products B, C, D, E, F. As a gripper 82 passes hopper 30, delivery is inhibited and the second hopper 31 then may supply gripper 82 with sheet material 24' that is different from sheet material 24 from first hopper 30. Thus, products B, C, D, E, F may contain either sheet material 24 or sheet material 24' as desired. Stacks 36, 37 may be supplied with a variety of sheet products, for example sheets containing carrier route sequencing information or addresses for each recipient.

In addition, for reducing downstream waste when a misfeed occurs, sheet material 24, 24' may not to be delivered on conveyor 60, and cam 85 can inhibit gripper 82 from releasing sheet material 24, 24' onto conveyor 60. Sheet material 24, 24' can be recycled past first hopper 30 and second hopper 31 again. Subsequently, hoppers 30, 31 are inhibited from delivering a new sheet material 24, 24' to the gripper 82.

Controller 80 preferably controls delivery of sheet material 24, 24' onto conveyor 60. Misfeed sensors 40, 41, gripper home sensor 42 and servo motors 72, 74 preferably control delivery of sheet material 24 or 24' to gripper 82 by inhibiting transfer drums 34, 35 so gripper 82 does not receive sheet material 24 or 24' when desired.

As shown in FIG. 2, product B and product C have already received the fourth sheet material 24 or 24' from transfer device 44 and are being conveyed to another hopper downstream in the gathering process to receive additional sheet material.

Product D receives sheet material 24 or 24' from gripper 82 and product E will receive sheet material 24, 24' as shown in FIG. 2. Cam 85 interacts with gripper 82 causing gripper 82 to release sheet material 24, 24' on conveyor 60 at corresponding receiving location 62.

If for example both hoppers misfeed or a misfeed is detected, the downstream transfer devices can also be inhibited as shown with sheet material 81. Controller 80 inhibits cam 85. Thus, gripper 82 does not release. Gripper 82 recycles sheet material 24, 24' back past first hopper 30 and second hopper 31. Therefore, the location for intended product (here the product ahead of product B) remains empty downstream of the misfeed and waste is reduced.

The present invention may also provide for grippers 82 to discard rejected sheet materials 24, 24'. When sequencing products B, C, D, etc. on conveyor 60, grippers 82 may discard sheet materials 24, 24' not deposited on conveyor 60 so sheet materials 24, 24' can be recycled and used later.

Conceivably, a single transfer device could weave back and forth all of the various sheet material feeders and have more than one delivery location to the conveyor 60, although this is not preferable as it would increase the overall length of the transfer device(s). Also, more than two hoppers could be provided for a single transfer device having a single delivery location.

The device may be a saddle stitcher, and inserter, or other similar gathering device.

What is claimed is:

1. A gathering device for forming a plurality of printed products comprising:

a transfer device having a plurality of grippers, each of the plurality of grippers traveling in a path around the transfer device;

a first sheet material feeder positioned so the first sheet material feeder is capable of delivering first sheet material to each of the plurality of grippers at a first location;

a second sheet material feeder positioned so the second sheet material feeder is capable of delivering second sheet material to each of the plurality of grippers at a second location downstream of the first location, the second sheet material feeder being downstream of the first sheet material feeder;

a conveyor receiving the first or second sheet material from the grippers at a delivery location to form a printed product; and a third sheet material feeder for delivering third sheet material to the conveyor upstream of the delivery location to form a printed product.

2. The gathering device as recited in claim 1 wherein the first sheet material is identical to the second sheet material.

3. The gathering device as recited in claim 1 wherein the first sheet material is different from the second sheet material.

4. The gathering device as recited in claim 1 further comprising a controller controlling at least one of the first and second sheet material feeders, the transfer device and the conveyor.

5. The gathering device as recited in claim 4 wherein the controller is capable of inhibiting delivery of the first sheet material onto the conveyor, recycling the first sheet material past the first and second sheet material feeders and inhibiting the first and second sheet material feeders as the first sheet material is recycled past the first and second sheet material feeders.

6. The gathering device as recited in claim 4 wherein the controller is capable of inhibiting delivery of the first or second sheet material onto the conveyor.

7. The gathering device as recited in claim 4 wherein the controller controls the transfer device.

8. The gathering device as recited in claim 4 wherein the controller controls the conveyor.

9. The gathering device as recited in claim 4 wherein the controller controls the first and second sheet material feeders.

10. The gathering device as recited in claim 4 wherein the controller determines via a misfeed sensor that the gripper travels downstream and the second sheet material feeder delivers the second sheet material to the gripper.

11. The gathering device as recited in claim 1 further comprising a sensor sensing the position of a gripper on the transfer device.

12. The gathering device as recited in claim 1 further comprising at least one sensor for sensing a misfeed of the first or second sheet material.

13. The gathering device as recited in claim 12 wherein there are two misfeed sensors.

14. The gathering device as recited in claim 12 wherein the misfeed sensor senses when grippers previously received first or second sheet material.

15. The gathering device as recited in claim 1 wherein the first and second sheet material feeders are sheet material hoppers.

16. The gathering device as recited in claim 1 wherein the conveyor is a saddle conveyor or a perfect binder conveyor.

17. The gathering device as recited in claim 1 wherein the first and second sheet material feeders and conveyor are driven by individual servo motors.

18. A gathering device for forming a plurality of printed products comprising:

a first transfer device;

a first sheet material feeder for delivering first sheet material to the first transfer device;

a second sheet material feeder for delivering second sheet material to the first transfer device;

a second transfer device;

a third sheet material feeder for delivering third sheet material to the second transfer device;

a fourth sheet material feeder for delivering fourth sheet material to the second transfer device; and a conveyor, the first and second transfer devices having respective first and second delivery locations at the conveyor, the conveyor receiving the first or second sheet material at the first delivery location and the third or fourth sheet material at the second delivery location.

19. A method for forming a printed product comprising the steps of:

gripping a first sheet material from a first sheet material feeder with a gripper;

passing the gripped first sheet material past a second sheet material feeder while inhibiting the second sheet material feeder from delivering a second sheet material to the gripper; and depositing the first sheet material on a conveyor to a form a printed product with a third sheet material.

* * * * *